US006659446B2

(12) United States Patent
Fischer et al.

(10) Patent No.: US 6,659,446 B2
(45) Date of Patent: Dec. 9, 2003

(54) GUIDING AND CARRYING ELEMENTS WITH THROTTLED BLOWING AIR

(75) Inventors: Uwe Fischer, Darmstadt (DE); Eckart Frankenberger, Darmstadt (DE); Michael Gieser, Oftersheim (DE); Christian Görbing, Heidelberg (DE); Peter Hachmann, Dossenheim (DE); Karl-Heinz Helmstädter, Heidelberg (DE); Christian Hieb, Neuhofen (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 23 days.

(21) Appl. No.: 09/944,514

(22) Filed: Aug. 31, 2001

(65) Prior Publication Data

US 2002/0070493 A1 Jun. 13, 2002

(30) Foreign Application Priority Data

Aug. 31, 2000 (DE) ..... 100 42 890

(51) Int. Cl.[7] ..... B65H 3/14
(52) U.S. Cl. ..... 271/97; 271/211; 271/195
(58) Field of Search ..... 271/97, 211, 195; 406/77, 79, 88

(56) References Cited

U.S. PATENT DOCUMENTS

| | | | | |
|---|---|---|---|---|
| 3,429,544 A | | 2/1969 | Williams et al. | |
| 3,902,647 A | * | 9/1975 | Neumann et al. | 226/97.3 |
| 3,951,401 A | | 4/1976 | Marass | |
| 4,522,388 A | * | 6/1985 | Heine et al. | 271/245 |
| 4,526,648 A | * | 7/1985 | Tochtermann | 156/497 |
| 5,379,999 A | * | 1/1995 | Barzideh et al. | 271/264 |
| 5,582,400 A | * | 12/1996 | Seydel | 271/176 |
| 5,687,964 A | * | 11/1997 | Stephan et al. | 271/195 |
| 5,718,176 A | * | 2/1998 | Stephan | 101/483 |
| 5,915,304 A | * | 6/1999 | Stiel | 101/416.1 |
| 5,927,203 A | * | 7/1999 | Gieser et al. | 101/419 |
| 6,038,998 A | * | 3/2000 | Platsch | 118/46 |
| 6,361,041 B2 | * | 3/2002 | Stephan | 271/195 |

FOREIGN PATENT DOCUMENTS

| | | |
|---|---|---|
| DE | 1110659 | 7/1961 |
| DE | 1 198 378 | 8/1965 |
| DE | 25 05 762 | 6/1976 |
| DE | 196 31 175 C1 | 1/1998 |
| DE | 198 57 745 A1 | 6/2000 |
| DE | 199 05 095 A1 | 8/2000 |

* cited by examiner

*Primary Examiner*—Donald P. Walsh
*Assistant Examiner*—Matthew J. Kohner
(74) *Attorney, Agent, or Firm*—Laurence A. Greenberg; Werner H. Stemer; Ralph E. Locher

(57) ABSTRACT

In a device for reducing the frictional force between a guiding or carrying element for sheets in a sheet-processing machine, in particular rotary printing machines, guiding and carrying elements acted upon by throttled blowing air include a sheet surface, orifices fluidically connected to a hollow interior, and a throttle disposed in the hollow interior. The elements are to be connected to an air source for blowing air out through the orifices and for generating an air cushion between a sheet and the sheet surface. Each of the orifices is preceded by the throttle with respect to a direction of air from the air source.

12 Claims, 6 Drawing Sheets

GUIDING AND CARRYING ELEMENTS WITH THROTTLED BLOWING AIR

BACKGROUND OF THE INVENTION

Field of the Invention:

The invention relates to a device for reducing the frictional force between a guiding or carrying element for sheets in a sheet-processing machine.

It is disclosed in German Published, Non-Prosecuted Patent Application DE 25 05 762 B, corresponding to U.S. Pat. No. 3,951,401 to Marass, to employ for sheets or sheet stacks carrying bars that are used to carry an auxiliary stack, particularly in the case of nonstop feed or delivery. To reduce the frictional force between the carrying bars and the sheet stack, blowing air is blown into the spaces between the carrying bars located at a distance from one another. Seals prevent the blowing air from flowing out and assist the buildup of an appropriate dynamic pressure.

SUMMARY OF THE INVENTION

It is accordingly an object of the invention to provide guiding and carrying elements with throttled blowing air that overcome the hereinafore-mentioned disadvantages of the heretofore-known devices of this general type and that reduces frictional force between guiding and carrying elements and sheets of a sheet-processing machine by using blowing air.

With the foregoing and other objects in view, there is provided, in accordance with the invention, a device for reducing a frictional force between sheets and guiding and carrying devices for sheets in a sheet-processing machine including a sheet transporting element defining a hollow interior, the sheet transporting element having a sheet surface, orifices fluidically connected to the hollow interior, and a throttle disposed in the hollow interior, the sheet transporting element to be connected to an air source for blowing air out through the orifices and for generating an air cushion between a sheet and the sheet surface of the sheet transporting element, and each of the orifices preceded by the throttle with respect to a direction of air from the air source.

One advantage of the invention is that additional sealing measures in the outer region of the sheet stack are no longer necessary.

Throttled nozzles that are disposed directly on the top side and the underside of the carrying bars generate, at the surfaces of contact between carrying bar and sheet, a high dynamic pressure along with a low throughflow. Advantageously, therefore, only a little blowing air escapes from nozzles that are not covered.

In accordance with another feature of the invention, throttled nozzles are used on so-called "separating shoes" that are disposed in the region of the front lay marks on the feed table. The separating shoes are guiding elements that are acted upon by blowing air and are disposed at a distance from one another transversely to the sheet transport direction such that the transporting and aligning device are disposed between the separating shoes. On an underside facing the sheet, the separating shoes have a number of orifices, from which throttled blowing air emerges, and the frictional force between the separating shoes and the sheet is, thus, reduced. Ideally, the sheet is guided, completely free of contact, below the separating shoes. It is advantageously proposed, furthermore, that cover marks be acted upon from inside by throttled blowing air that can emerge from orifices, in particular, on the top side of the cover marks, so that a sheet drawn by the front lay marks comes into contact as little as possible, preferably free of contact, with the cover marks.

In accordance with a further feature of the invention, the throttle is a throttle section.

In accordance with an added feature of the invention, the sheet transporting element is one of a sheet guiding element and a sheet carrying element.

In accordance with an additional feature of the invention, the orifices are throttled air nozzles.

In accordance with yet another feature of the invention, advantageously, the configuration of the throttled nozzles is such that each of the orifices is connected to an air pressure generator through an air throttle. The air throttle may be integrated into the air guidance system at a distance from the respective throttled air nozzle. However, the air throttle and the air nozzle throttled by the air throttle may form a structural unit in the form of a throttle nozzle. In the last-mentioned case, each of the throttled air nozzles is assigned its own air throttle. However, an air throttle may also be provided that is connected pneumatically to a plurality of throttled air nozzles simultaneously through the air guidance system.

In accordance with yet a further feature of the invention, the air throttle has located in it, as its integral part, a so-called packing column, the small packing bodies of which form flow resistances for the suction or blowing air flowing through the air throttle and generated by the air pressure generator.

In accordance with yet an added feature of the invention, the air throttle has located in it, as its integral part, a throttle piece, resembling an air filter, which forms a flow resistance for the suction or blowing air. For example, the throttle piece is a textile layer that may be woven or nonwoven. However, the throttle piece may also be a porous and, therefore, air-permeable sponge that is foamed from a plastic.

In accordance with yet an additional feature of the invention, the air throttle is fitted with air barriers that project into the flow path of the suction or blowing air and that delimit swirl chambers that are disposed between each of the projecting air barriers.

In accordance with again another feature of the invention, the air throttle is configured as a so-called perforated-plate labyrinth. The plates are disposed one above the other and swirl chambers are disposed between each of the perforated plates.

In accordance with again a further feature of the invention, the throttle is a spiral air duct.

In accordance with again an added feature of the invention, the throttled air nozzles are blowing nozzles.

In accordance with again an additional feature of the invention, the orifices are blowing nozzles.

With the objects of the invention in view, there is also provided a device for reducing a frictional force between sheets and an auxiliary stack table for sheets in a feeder of a sheet-processing machine including a rake bar defining a hollow interior. The rake bar has a sheet surface, orifices fluidically connected to the hollow interior, and a throttle disposed in the hollow interior. The rake bar is connected to an air source for blowing air out through the orifices and for generating an air cushion between a sheet and the sheet surface of the rake bar. Each of the orifices is preceded by the throttle with respect to a direction of air from the air source.

With the objects of the invention in view, there is also provided a device for reducing a frictional force between sheets and an auxiliary stack table for sheets in a delivery of a sheet-processing machine including a rake bar defining a hollow interior. The rake bar has a sheet surface, orifices fluidically connected to the hollow interior, and a throttle disposed in the hollow interior. The rake bar is connected to an air source for blowing air out through the orifices and for generating an air cushion between a sheet and the sheet surface of the rake bar. Each of the orifices is preceded by the throttle with respect to a direction of air from the air source.

With the objects of the invention in view, there is also provided a sheet-fed rotary printing machine including sheet guiding and carrying devices and a sheet transporting element for reducing a frictional force between sheets and the guiding and carrying devices. The sheet transporting element cooperates with the sheet guiding and carrying devices to convey sheets in a printing machine. The sheet transporting element defines a hollow interior. The sheet transporting element has a sheet surface, orifices fluidically connected to the hollow interior, and a throttle disposed in the hollow interior. The sheet transporting element is connected to an air source for blowing air out through the orifices and for generating an air cushion between a sheet and the sheet surface of the sheet transporting element. Each of the orifices is preceded by the throttle with respect to a direction of air from the air source.

Other features that are considered as characteristic for the invention are set forth in the appended claims.

Although the invention is illustrated and described herein as embodied in guiding and carrying elements with throttled blowing air, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 7*b* is a fragmentary, cross-sectional side view of the embodiment of FIG. 7*a.

DESCRIPTION OF THE PREFERRED EMBODIMENTS

Figure 1:
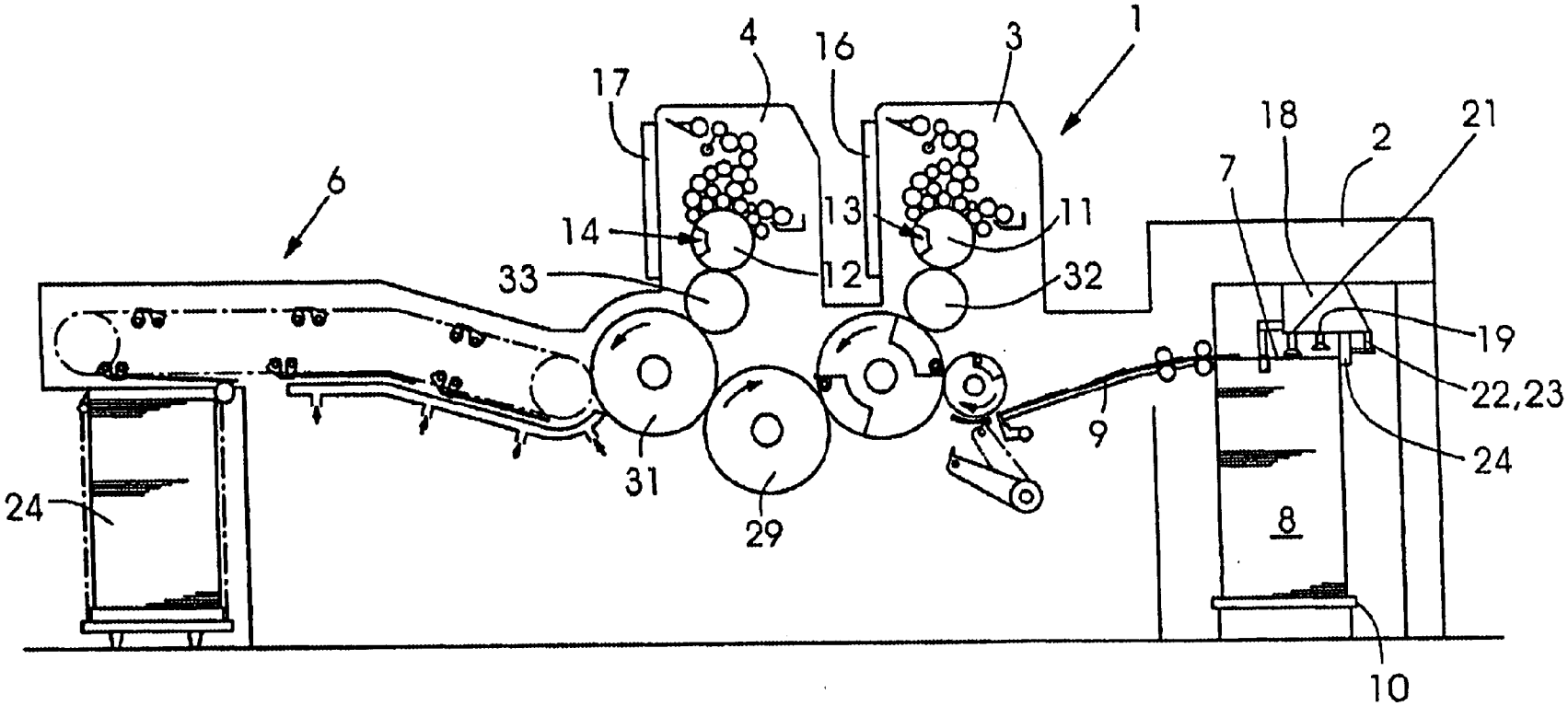
FIG. 1 is a diagrammatic cross-sectional view of a sheet-processing machine according to the invention.
Figure 2:
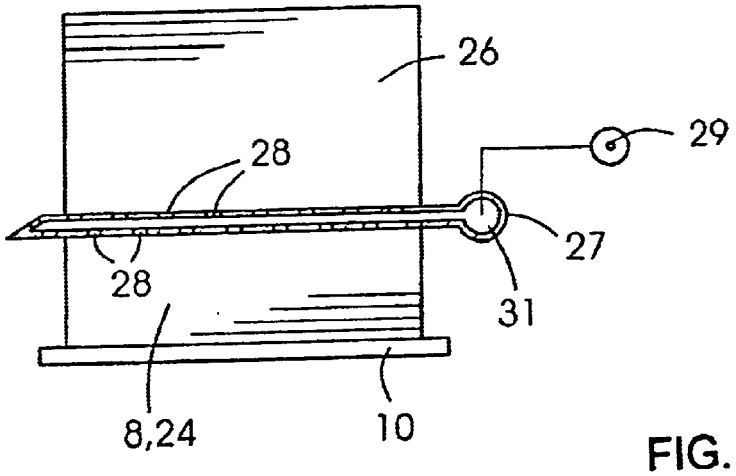
FIG. 2 is a diagrammatic cross-sectional view of a rake bar for carrying a sheet stack of FIG. 1.
Figure 3:
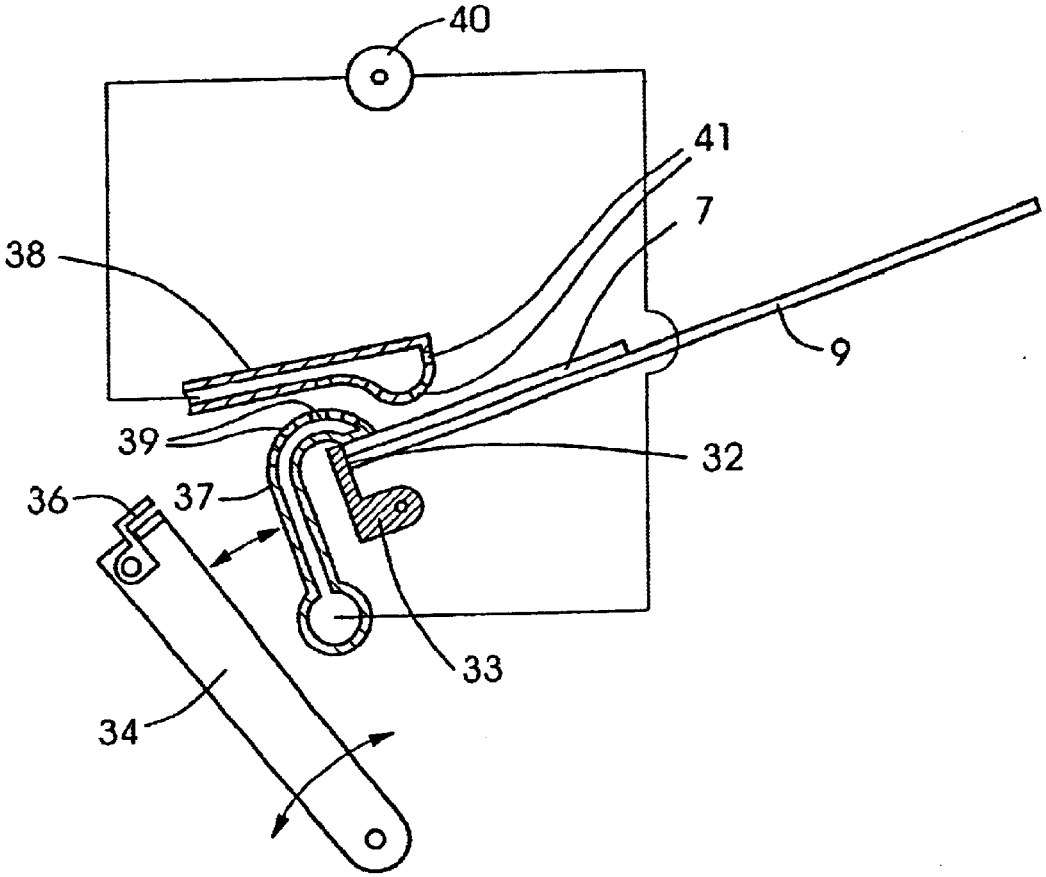
FIG. 3 is a diagrammatic cross-sectional view of a separating shoe and a cover mark in the region of the front lay marks of FIG. 1.

In all the figures of the drawing, sub-features and integral parts that correspond to one another bear the same reference symbol in each case. Related applications having the application Ser. Nos. (Ser. Nos. 09/944,579, 09/944,566 and 09/944,570) are hereby incorporated herein by reference.

Referring now to the figures of the drawings in detail and first, particularly to FIG. 1 thereof, there is shown a rotary printing machine, for example, a sheet-processing printing machine 1 having a feeder 2, at least one printing unit 3, 4, and a delivery 6. The sheets 7 are taken from a sheet stack 8 and fed, individually or imbricated, to the printing units 3, 4 through a feed table 9. These printing units each contain a conventional plate cylinder 11, 12. The plate cylinders 11 and 12 each have a device 13, 14 for fastening flexible printing plates. Furthermore, each plate cylinder 11, 12 is assigned a device 16, 17 for the semiautomatic or fully automatic change of a printing plate.

The sheet stack 8 lies on a stack plate 10 capable of being raised in a controlled manner. The sheets 7 are taken from the top side of the sheet stack 8 by a so-called suction head 18 that has inter alia a number of lifting and dragging suckers 19, 21 for the individual separation of the sheets 7. Moreover, a blowing device or means 22 for loosening the upper sheet layers and tracer elements 23 for stack tracking are provided. A number of lateral and rear stops are provided for the alignment of the sheet stack 8, in particular, of the upper sheets 7 of the sheet stack 8.

After the processing of the sheets 7, the sheets 7 are deposited onto a depositing stack 24 in the delivery 6. New sheet stacks 8 must be fed to the feeder 2 and the sheet stacks 24 of the delivery 6 must be removed so that printing can be carried out without interruption. Holding elements in the form of rake bars 27 disposed parallel and next to one another are provided so that the respective remaining stacks 26 can be carried. The rake bars 27 have a number of blowing orifices 28, out of which throttled blowing air flows, so that the rake bars 27 can be pushed in between the sheet layers with little effort. The throttled blowing air has the effect that an air cushion that reduces the frictional force between sheet and rake bar 27 is built up in the vicinity of the surface of the rake bars 27. Due to the use of throttled blowing air, only a little blowing air flows out of the blowing orifices 28. Thus, even when the rake bar 27 is pushed in, when still not all the blowing orifices 28 are covered, a sufficiently high air pressure prevails at the orifices 28 of the rake bar 27 that are covered by the sheets. A common blowing-air source 29 supplies the rake bars 27 disposed next to one another through a common hollow crossmember 31.

In a second exemplary embodiment, pivotable front lay marks 33 are provided at a front edge 32 of the feed table 9, at which the sheets 7 are aligned in the circumferential direction. Furthermore, a pregripper 34 picks up the aligned sheets 7 by its pregripper gripper 36 and transfers them onto a first sheet-guiding cylinder of the printing machine 1. A number of pivotable cover marks 37, disposed parallel and next to one another with clearances, prevent a sheet 7 from shooting over the front lay marks 33 during alignment. Disposed parallel and next to one another in the clearances between the cover marks 37 are a number of guiding bars 38, otherwise referred to as "separating shoes", which form a guide for the sheets 7 transported by the pregripper 34 and, thus, prevent a sheet 7 from being overturned during its transport from the feed table 9. Thus, a sheet 7 is led through between a top side of the cover marks 37 and an underside of the separating shoes 38. To reduce the frictional force between the sheets 7 and the cover marks 38 or separating shoes 38, they are acted upon from inside by throttled blowing air from a blowing-air source 40, which can flow out of correspondingly disposed blowing orifices 39, 41. In such a case, the throttled blowing air forms, particularly in the vicinity of the top side of the cover mark 37 and of the underside of the separating shoes 38, a high-pressure air layer, at the same time with a low volume flow. The air layer reduces the frictional force between the sheet 7 and the separating shoes 38 or cover marks 37 to such an extent that the sheets 7 are ideally guided free of contact. Undesirable marking, particularly on already preprinted sheets 7, is, thus, avoided.

Figure 4:
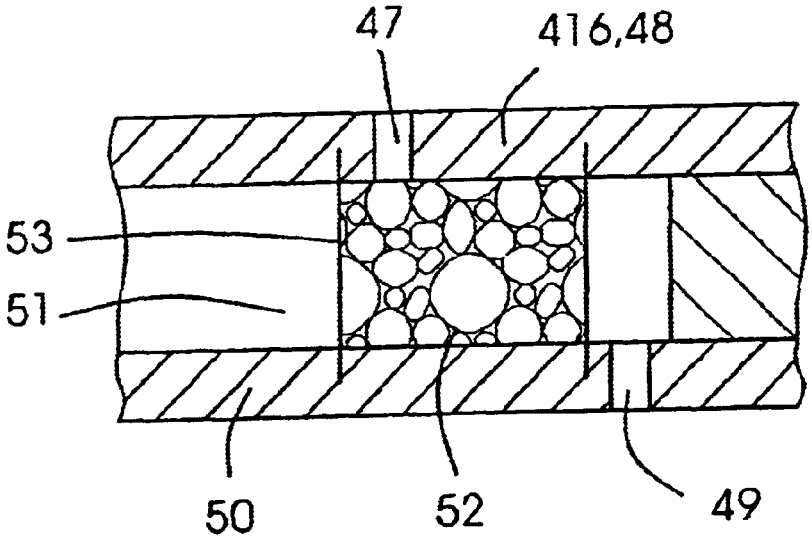
FIG. 4 is a fragmentary, cross-sectional view of an embodiment of the air throttle of FIG. 2.
Figure 5:
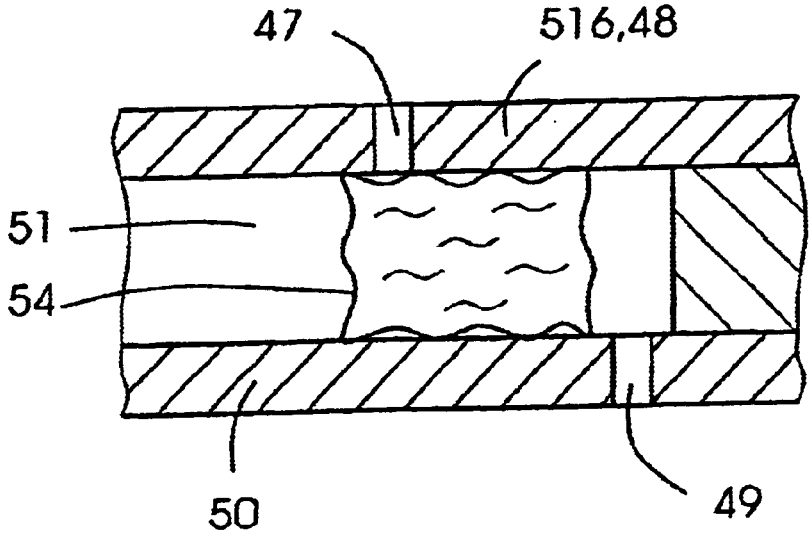
FIG. 5 is a fragmentary, cross-sectional view of a second embodiment of the air throttle of FIG. 2.

To generate throttled blowing air at the orifices 28 of the rake bars 27, the orifices 41 of the separating shoes 38 and the orifices 39 of the cover marks 37, the following air throttles are proposed. Components marked by reference symbols 47 to 51 explained in detail in FIG. 4 are also found again in the variants of the air throttles 516, 616, 716, 816 illustrated in FIGS. 5 to 8, thus, the reference symbols 47 to 51 in FIGS. 5 to 8 are used again without further explanation. In the variant of the air throttle 516, as shown in FIG. 5, the packing 52 of FIG. 4 is replaced by a textile throttle piece 54, such as, for example, a woven or a nonwoven fabric, inserted into the throttle chamber 51. To fill the throttle chamber 51 from the throttle bottom 50 to the throttle top 48 with the throttle piece 54, the throttle piece 54 may be made of a single sufficiently bulky layer or be wound up into a multilayered insert or be stretched open in the throttle chamber 51. The blowing air flowing through the throttle piece 54 is throttled as a result of accumulations of threads or fibers and of turbulences in pores of the throttle piece 54.

Figure 6A:
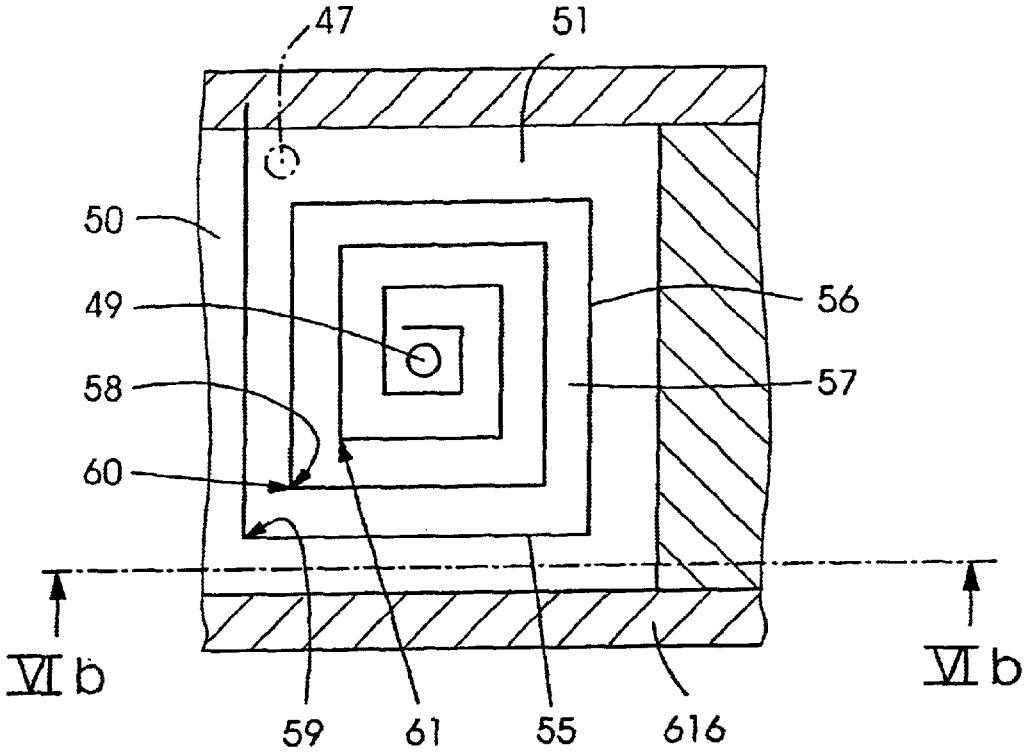
FIG. 6*a* is a fragmentary, cross-sectional plan view of a third embodiment of the air throttle of FIG. 2.
Figure 6B:
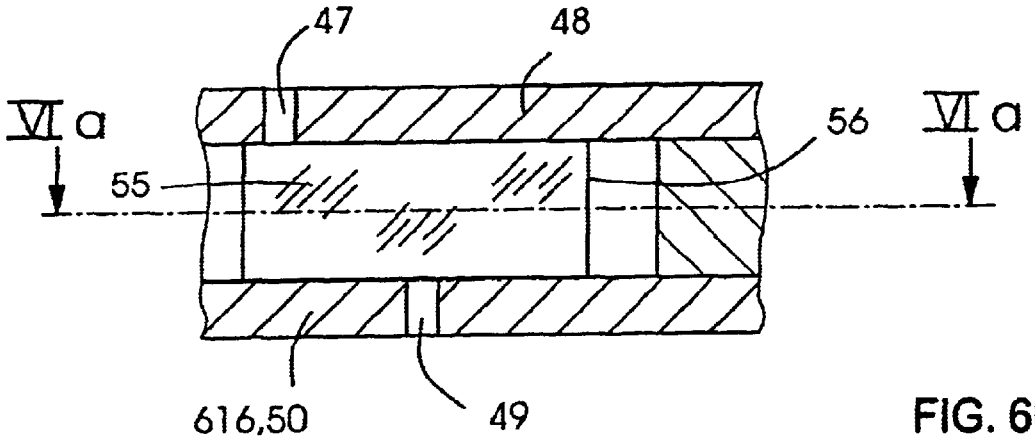
FIG. 6*b* is a fragmentary, cross-sectional side view of the embodiment of FIG. 6*a;*

FIGS. 6*a* (a horizontal section along the sectional line VIa—VIa in FIG. 6*b*) and 6*b* (a vertical section along the sectional line VIb—VIb in FIG. 6*a*) illustrate an air throttle 616, the air guide walls 55 and 56 of which are disposed orthogonally together in the throttle chamber 51, so that an air duct 57 in the form of a polygonal spiral, guiding the blowing air between the air guide walls 55 and 56 from the throttle inlet 47 to the throttle outlet 49, is obtained. The suction or blowing air flowing through the air duct accumulates in corner angles 58, 59 of the air duct 57 and swirls at corner edges 60, 61 of the air guide walls 55 and 56, so that the airstream is throttled. The air guide walls 55, 56 have very high surface roughness that is brought about, for example, by sandblasting, that contributes to reducing the flow velocity of the blowing air in the air duct 57 by an increase in friction.

Figure 7A:
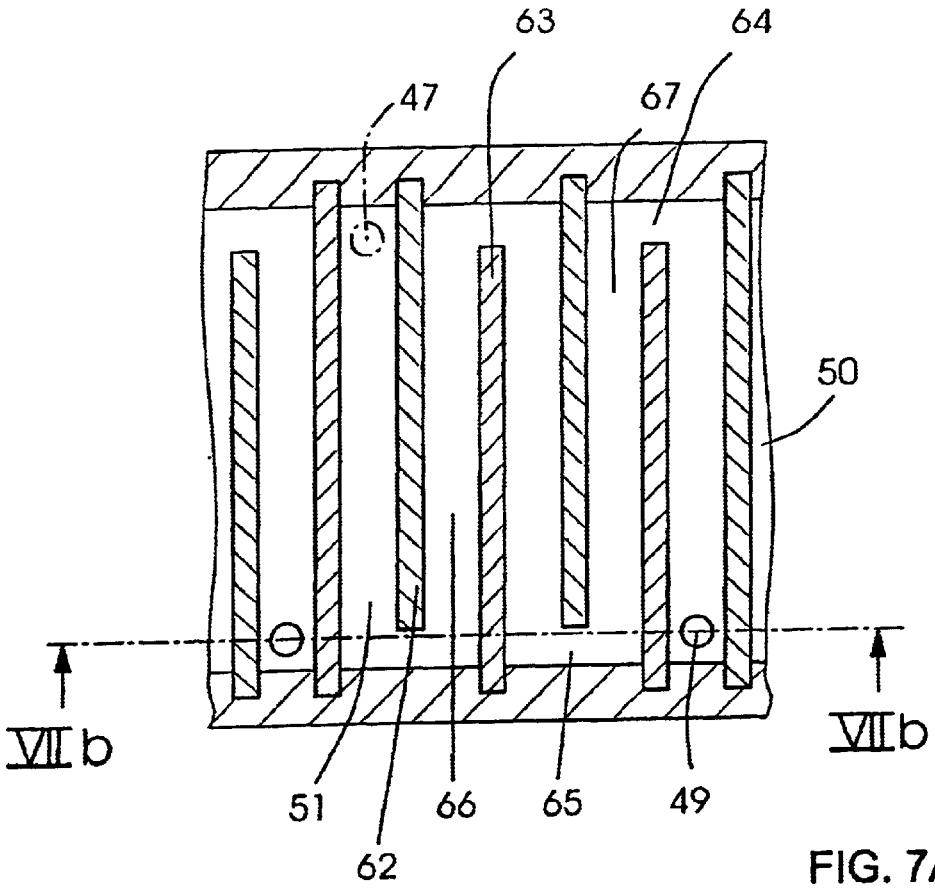
FIG. 7*a* is a fragmentary, cross-sectional plan view of a fourth embodiment of the air throttle of FIG. 2.
Figure 7B:
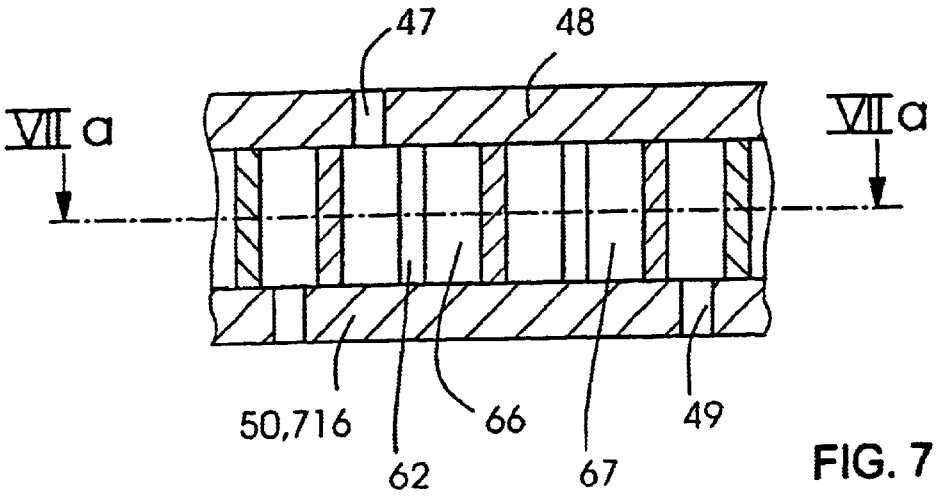

In the case of the air throttle 716—cf. FIG. 7*a* (a horizontal cross-section) and 7*b* (a vertical cross-section), the throttle chamber 51 is fitted with air barriers 62, 63 in the form of baffle walls. The air barriers 62, 63 are disposed alternately in two rows and so as to overlap one another with the exception of narrow air gaps 64, 65. Located between the air barriers 62, 63 are swirl chambers 74, 75 that, together with the air gaps 64, 65, form a meanderlike air duct that leads from the throttle inlet 47 to the throttle outlet 49 and in which the blowing air is throttled.

Figure 8:
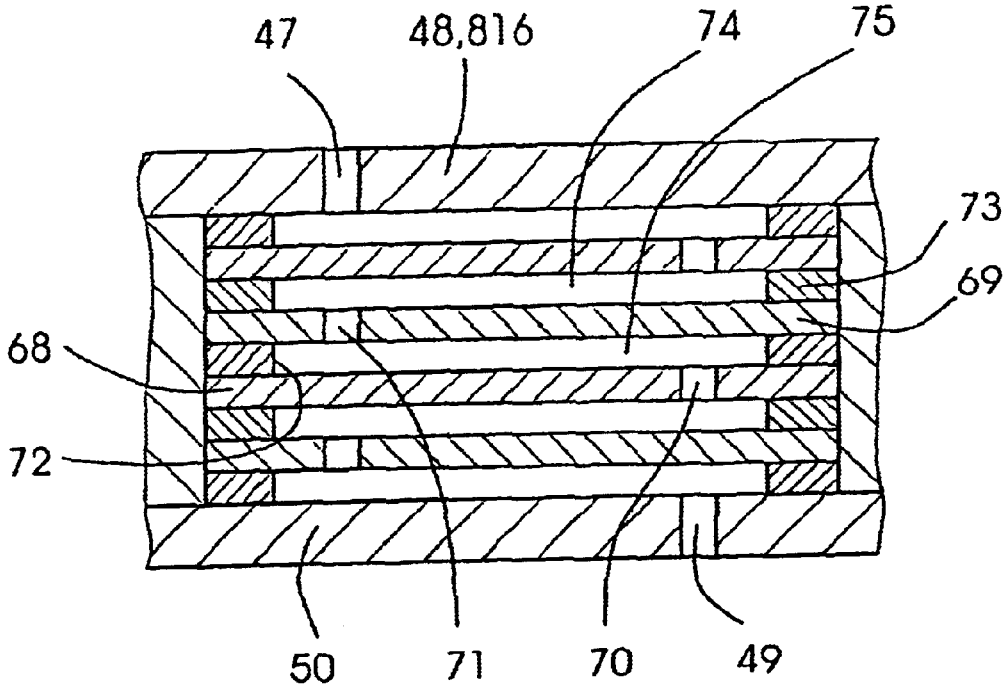
* and FIG. 8 is a fragmentary, cross-sectional view of a fifth embodiment of the air throttle of FIG. 2.

FIG. 8 illustrates a cross-section through the air throttle 816 that is made of perforated plates 68, 69 disposed one above the other in a sandwich form of construction in the throttle chamber 51. Each of the perforated plates 68, 69 has at least one hole 70, 71 that is disposed in the plate plane so as to be offset to at least one hole 71, 70 of the respectively adjacent perforated plate. The holes 70, 71 are, thus, out of alignment with one another and overlap with closed plate surfaces of the perforated plates 68, 69. The spacer pieces 72, 73 hold the perforated plates 68, 69 at a distance from one another and define volumes of swirl chambers 74, 75 that are located between the perforated plates 68, 69 and through that the blowing air flows. The blowing air flows accumulate in front of the holes 70, 71 constituting narrow points in the flow path and swirls in the swirl chambers 74, 75. The throttling action of the air throttle 816 is based, in exactly the same way as the throttling action of the air throttles 616 and 716, on a reduction in the flow velocity of the blowing air by a multiple deflection of the air flow in the throttle chamber 51.

Further advantages are provided by the invention. In the case of the combination of the air throttle 416, 516, 616, 716, or 816 with an orifice 28, 39, 41, the air throughflow becomes so small that, on one hand, large quantities of blowing air do not have to be discharged and, on the other hand, too much air cannot escape in the case of orifices that are not covered. A blowing force is exerted on the print carrier sheet by the throttled blowing nozzle, which, with an increasing distance of the sheet from the blowing nozzle, decreases more than linearly. Thus, a desirable, much thinner air cushion can be generated between an orifice 28, 39, 41 provided with the throttled blowing nozzle, for example, on the surface of the rake bar 27, the cover mark 37, or separating shoe 38 of the sheet 7, than is possible with conventional, in other words, unthrottled blowing nozzles.

We claim:

1. A device for reducing a frictional force between sheets and guiding and carrying devices for sheets in a sheet-processing machine, comprising:

a sheet transporting element defining a hollow interior;

said sheet transporting element having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said sheet transporting element to be connected to an air source for blowing air out through said orifices and for generating an air cushion between a sheet and said sheet surface of said sheet transporting element; and each of said orifices preceded by said throttle with respect to a direction of air from the air source.

2. The device according to claim 1, wherein said throttle is a throttle section.

3. The device according to claim 1, wherein said sheet transporting element is one of a sheet guiding element and a sheet carrying element.

4. The device according to claim 1, wherein said orifices are throttled air nozzles.

5. The device according to claim 4, wherein:

said throttle is a plurality of air throttles; and each of said throttled air nozzles have at least one of said air throttles.

6. The device according to claim 4, wherein said throttled air nozzles are blowing nozzles.

7. The device according to claim 1, wherein said orifices are blowing nozzles.

8. A device for reducing a frictional force between sheets and a feed table for sheets in a sheet-processing machine, the feed table having an alignment region, the device comprising:

a separating shoe defining a hollow interior;

said separating shoe having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said separating shoe disposed in an alignment region of the feed table;

said separating shoe to be connected to an air source for blowing air out through said orifices and for generating an air cushion between a sheet and said sheet surface of said separating shoe; and each of said orifices preceded by said throttle with respect to a direction of air from the air source.

9. A device for reducing a frictional force between sheets and a feed table for sheets in a sheet-processing machine, the feed table having an alignment region, the device comprising:

a cover mark defining a hollow interior;

said cover mark having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said cover mark disposed in an alignment region of the feed table;

said cover mark to be connected to an air source for blowing air out through said orifices and for generating an air cushion between a sheet and said sheet surface of said cover mark; and each of said orifices preceded by said throttle with respect to a direction of air from the air source.

10. A device for reducing a frictional force between sheets and an auxiliary stack table for sheets in a feeder of a sheet-processing machine, comprising:

a rake bar defining a hollow interior;

said rake bar having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said rake bar to be connected to an air source for blowing air out through said orifices and for generating an air cushion between a sheet and said sheet surface of said rake bar; and each of said orifices preceded by said throttle with respect to a direction of air from the air source.

11. A device for reducing a frictional force between sheets and an auxiliary stack table for sheets in a delivery of a sheet-processing machine, comprising:

a rake bar defining a hollow interior;

said rake bar having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said rake bar to be connected to an air source for blowing air out through said orifices and for generating an air cushion between a sheet and said sheet surface of said rake bar; and each of said orifices preceded by said throttle with respect to a direction of air from the air source.

12. A sheet-fed rotary printing machine, comprising:

sheet guiding and carrying devices;

a sheet transporting element for reducing a frictional force between sheets and said guiding and carrying devices;

said sheet transporting element cooperating with said sheet guiding and carrying devices to convey sheets in a printing machine;

said sheet transporting element defining a hollow interior;

said sheet transporting element having:

a sheet surface;

orifices fluidically connected to said hollow interior; and a throttle disposed in said hollow interior, said throttle being a plurality of perforated plates disposed one above the other, and swirl chambers being disposed between each of said perforated plates;

said sheet transporting element to be connected to an air source for blowing air out through said orifices and for generating an air cushion between a sheet and said sheet surface of said sheet transporting element; and each of said orifices preceded by said throttle with respect to a direction of air from the air source.

* * * * *